US010253569B2

(12) United States Patent
Ellison

(10) Patent No.: US 10,253,569 B2
(45) Date of Patent: Apr. 9, 2019

(54) WELLBORE INSTALLATION APPARATUS AND ASSOCIATED METHODS

(71) Applicant: Enovate Systems Limited, Aberdeen, Abersdeenshire (GB)

(72) Inventor: Stuart Ellison, Aberdeen (GB)

(73) Assignee: ENOVATE SYSTEMS LIMITED (GB)

( * ) Notice: Subject to any disclaimer, the term of this patent is extended or adjusted under 35 U.S.C. 154(b) by 0 days.

(21) Appl. No.: 15/111,254

(22) PCT Filed: Feb. 9, 2015

(86) PCT No.: PCT/GB2015/050341

§ 371 (c)(1),
(2) Date: Jul. 13, 2016

(87) PCT Pub. No.: WO2015/118348

PCT Pub. Date: Aug. 13, 2015

(65) Prior Publication Data

US 2016/0333641 A1 Nov. 17, 2016

(30) Foreign Application Priority Data

Feb. 7, 2014 (GB) ..... 1402176.0

(51) Int. Cl.
*E21B 7/20* (2006.01)
*E21B 33/035* (2006.01)
(Continued)

(52) U.S. Cl.
CPC ..... *E21B 7/20* (2013.01); *E21B 7/18* (2013.01); *E21B 33/035* (2013.01); *E21B 33/043* (2013.01)

(58) Field of Classification Search
CPC ..... E21B 7/20; E21B 33/035; E21B 33/043; E21B 7/18
See application file for complete search history.

(56) References Cited

U.S. PATENT DOCUMENTS 3,344,612 A * 10/1967 Rininger ..... E21B 7/12 166/359
3,376,922 A * 4/1968 Leonhardt, Jr. ..... E21B 7/12 166/349

(Continued)

FOREIGN PATENT DOCUMENTS

CA 1194410 10/1985
WO 0165050 A1 9/2001

(Continued)

OTHER PUBLICATIONS

International Search Report to corresponding PCT Pat. Appl. No. PCT/GB2015/050341, dated Jan. 6, 2015, 3 pages.

*Primary Examiner* — Matthew R Buck
(74) *Attorney, Agent, or Firm* — Tarolli, Sundheim, Covell & Tummino LLP

(57) ABSTRACT

The invention relates to an apparatus (10) for installing a wellbore (12) on a seabed (14). The apparatus includes a suction member (16) including a housing (17) defining a chamber (18). The housing (17) has an open end (20). The open end (20) defines a leading edge (22) for engagement with the seabed (14). The apparatus (10) includes a wellhead located (24) at an end opposite the open end (20) for engagement with a conduit (28). The conduit (28) is coupled to the housing (17). The conduit (28) extends from the wellhead means (24) through the chamber (18). When the wellbore (12) is installed on the seabed, the apparatus (10) provides a barrier or well barrier, which is capable of isolating and/or maintaining a wellbore pressure. The apparatus (10) allows for the installation of a wellhead (24) and/or a conduit (28) without the need of prior drilling and/or jetting operations at a wellbore site.

29 Claims, 4 Drawing Sheets

(51) Int. Cl.
*E21B 33/043* (2006.01)
*E21B 7/18* (2006.01)

(56) References Cited

U.S. PATENT DOCUMENTS 3,891,031 A * 6/1975 Ortiz ..... E21B 33/12 166/106
4,558,744 A * 12/1985 Gibb ..... E21B 7/185 166/222
4,572,304 A * 2/1986 Mahar ..... E02D 1/022 114/296
4,721,415 A * 1/1988 Shatto ..... E02D 23/02 114/296
4,759,413 A * 7/1988 Bailey ..... E21B 7/124 175/171
4,813,496 A * 3/1989 Rohweller ..... E21B 7/128 166/340
4,830,541 A * 5/1989 Shatto ..... E02D 23/16 166/368
5,050,680 A * 9/1991 Diehl ..... E21B 33/037 137/312
6,659,182 B1 * 12/2003 Saugier ..... E21B 19/002 166/358
6,692,194 B2 * 2/2004 Strand ..... E21B 7/12 114/296
8,523,491 B2 * 9/2013 Brinkmann ..... E02B 17/0021 114/265
8,950,500 B2 * 2/2015 Lieske, II ..... E21B 43/0122 166/358
8,967,292 B2 * 3/2015 Hammersmark ..... E21B 7/128 166/358
2012/0003048 A1 * 1/2012 Hosoy ..... B63B 21/27 405/172
2012/0018165 A1 * 1/2012 Crossley ..... E21B 33/037 166/344

FOREIGN PATENT DOCUMENTS

WO 2010068119 A1 6/2010
WO 2011162616 A1 12/2011

* cited by examiner

WELLBORE INSTALLATION APPARATUS AND ASSOCIATED METHODS

RELATED APPLICATIONS

The present application is a U.S. National Stage under 35 USC 371 patent application, claiming priority to Serial No. PCT/GB2015/050341, filed on Feb. 9, 2015, which claims priority from GB 1402176.0, filed on Feb. 7, 2014, both of which are incorporated herein by reference.

FIELD OF THE INVENTION

The present invention relates to an apparatus and method for installing a wellbore on a seabed.

BACKGROUND

Subsea wellbores can be drilled using a dedicated drilling vessel or drilling rig. The drilling vessel can be used to drill a series of successively smaller wellbores and install one or more conductors in the wellbores in order to maintain hole integrity and establish well control.

A large open water hole may be drilled or jetted for running a length of conductor connected to a low pressure wellhead housing. Subsequently, a second smaller hole may be drilled within the first into which a length of surface casing connected to a high pressure wellhead housing may be run. These two casing strings can be suspended from wellheads located at the seabed. This method of drilling can result in large quantities of drill cuttings and drilling fluids being deposited into the environment. This method of drilling can be vulnerable to shallow gas encounters and can depend on equipment such as a rotary table, a top drive, a derrick, etc., which may be only available on a dedicated drilling vessel. Once the high pressure wellhead is installed on the seabed the dedicated drilling vessel may run and install the BOP stack, which may be followed by the installation of a marine riser. From this point forward a full well control package may be available, which can respond to any wellbore influx. The use of a dedicated drilling vessel or drilling rig can be very costly and time intensive.

A method and associated apparatus for setting one or more conductor casing strings is described in WO01/65050 (Strand, H.). The Strand apparatus and method requires the use of a suction substructure, which allows the installation of conductor casing by means of piling.

U.S. Pat. No. 4,830,541 describes an apparatus, which is equipped with a venture suction device and a central opening for receiving a well conductor pipe.

SUMMARY OF THE INVENTION

According to a first aspect of the present invention there is provided an apparatus for installing a wellbore on a seabed comprising a suction means comprising a housing defining a chamber, the housing having an open end, wherein the open end defines a leading edge for engagement with the seabed, a wellhead means located at an end opposite the open end for engagement with at least one conduit, the at least one conduit being coupled to the housing, wherein the at least one conduit extends substantially from the wellhead means through the chamber, when the wellbore is installed on the seabed, the apparatus provides a barrier or well barrier, which is capable of isolating and/or maintaining a (internal) wellbore pressure.

For example, the apparatus may provide a barrier, which may be capable of isolating pressurised well bore fluids from the surrounding formation and/or environment. The apparatus may be installed at a desired and/or pre-determined depth under the seabed. The apparatus may allow for the installation of a wellbore, wellhead means and/or the at least one conduit without the need of prior drilling and/or jetting operations at a wellbore site. The housing of the suction means may comprise, define or form a tubular member or skirt. The tubular member or skirt may be arranged so as to surround the at least one conduit. The housing of the suction means may include a lid, which may be provided at the end opposite the open end. The lid may be arranged so as to enclose or define the chamber of the housing. The lid and/or tubular member may integrally form or define the housing (e.g. the suction means). The open end may be arranged opposite of the lid of the housing. The housing (e.g. the suction means) may be of a cylindrical and/or annular shape.

The lid may include at least one first opening or aperture. The first opening or aperture may be configured for receiving the wellhead means. The wellhead means may be formed or arranged, e.g. integrally formed or arranged, on or within the housing e.g. on or within the first opening of the lid. The wellhead means may be attached or fixed to the housing (e.g. the suction means) so as to substantially restrict movement and/or deflection of the wellhead means with respect to the housing. In some examples, the wellhead means may be fixed, such as rigidly fixed, to the housing, e.g. by at least one mechanical lock. In other examples, the wellhead means may be welded to the housing. Alternatively, the wellhead means may be releasably attached or secured to the housing and/or the first opening of the lid. The wellhead means may be attached or fixed to the housing so as to create a (low) pressure containing seal between the wellhead means and the housing. The wellhead means may comprise high pressure wellhead means. For example, the wellhead means may comprise a slimline rigid lock down (SRLD) wellhead (e.g. from Aker Solutions).

The at least one conduit may be releasably coupled to the housing. Releasably coupling the at least one conduit to the housing may allow for replacement and/or retrofitting of the at least one conduit to the housing. In other examples, the at least one conduit may be integral or integrated with the housing. Alternatively or additionally, the at least one conduit may be permanently coupled to the housing.

The wellhead means may couple or connect, e.g. releasably couple or connect, the at least one conduit to the housing. In other examples, the at least one conduit may be integral or integrated with the wellhead means. Alternatively or additionally, the at least one conduit may be permanently coupled to the wellhead means. The wellhead means may comprise or define an interface, e.g. a casing hanger, for connecting the at least one conduit to the housing. The wellhead means may fix and/or attach, e.g. rigidly fix and/or attach, the at least one conduit to the housing (e.g. the suction means).

The housing, wellhead means and/or the at least conduit may define and/or form, e.g. integrally define and/or form, the apparatus.

In some examples, the at least one conduit may comprise means for suspending and/or connecting at least one further conduit.

The at least one conduit may be concentrically and/or coaxially arranged within the chamber of the housing (e.g. the suction means). The at least one conduit may extend or be arranged substantially parallel with respect to the tubular member of the housing. In some examples, the at least one conduit may protrude or extend beyond the open end of the housing. In other examples, the at least conduit may coincide or be longitudinally aligned with the open end of the housing. Alternatively, the at least conduit may be retracted from the open end of the housing, i.e. a length of the at least one conduit may be smaller than a length of the suction means or tubular member of the housing. The length of the at least one conduit may be in a range of 5 to 20 m, and preferably about 8 m.

The at least one conduit may comprise at least one casing, conductor, tubular or the like. The at least one conduit may be cylindrical.

The diameter of the at least one conduit may be in the range of 10 to 30 inch (25.4 cm to 76.2 cm), and preferably about 20 inch (50.8 cm). The diameter of the housing may be in the range of 50 inch to 200 inch (1.27 m to 5.08 m), and preferably about 150 inch (3.81 m). The diameter of the housing is larger than the diameter of the at least one conduit. The larger diameter of the housing may enhance a structural integrity of the apparatus, such as a resistance to bending of the at least one conduit and/or housing.

The housing may comprise one or more centralising means. The centralising means may be arranged within the chamber of the housing. The centralising means may provide or maintain an orientation and/or position of the at least one conduit within the chamber of the housing. For example, the centralising means may orient or position the at least one conduit so that the at least one conduit may extend substantially through a centre of the chamber of the housing. Alternatively or additionally, the centralising means may enhance the structural integrity of the apparatus, e.g. increase bending resilience of the at least one conduit, housing and/or apparatus.

The apparatus and/or housing may comprise one or more load paths, e.g. lateral load paths e.g. vertically spaced or displaced from one another. By providing the apparatus and/or housing with one or more lateral load paths, structural integrity of the apparatus may be enhanced, such as the resistance to bending of the at least one conduit, housing and/or apparatus, e.g. in use.

For example, the centralising means may provide at least one load path, such as at least one lateral load path. The at least one load path may lead to an increased resistance to bending of the at least one conduit, housing and/or apparatus. The centralising means may be provided proximal to the open end and/or at a lower portion of the housing. The wellhead means and/or the coupling of the at least one conduit to the housing may provide at least one further load path, such as at least one further lateral load path, e.g. vertically spaced or displaced from the at least one load path.

The one or more centralising means may comprise at least one centralising member, e.g. radial centralising member. The at least one centralising members may be coupled between the interior of the housing and the at least one conduit, e.g. to maintain the at least one conduit in a centralised position and/or provide a lateral load path.

The at least one conduit may comprise or define at least one guiding portion, located on a distal end of the at least one conduit. The guiding portion may facilitate engagement of the at least one conduit with the seabed upon insertion of the apparatus into the seabed. In some examples, the guiding portion may be a shoe or guide shoe, which may comprise a rounded profile.

In use, the apparatus may be suspended or suspendable from a vessel or surface vessel. In some examples, the apparatus may be lowered from a vessel to the seabed by one or more tethers, lines, chains or the like, in use. In other examples, the apparatus may be lowered using a wire and/or a spooled tensile member, such as coiled tubing.

In use, the apparatus may be located or positioned on the seabed in an upright or vertical orientation, i.e. the lid may be located substantially opposite of the seabed.

In use, the guiding portion of the at least one conduit and/or the open end (or leading edge) of the chamber may engage with the seabed. Upon contact with the seabed, the guiding portion of the at least one conduit and/or the open end (or leading edge) of the chamber may penetrate or pierce the seabed, e.g. due to a weight or self-weight of the apparatus.

In use, a seal may be formed between the housing (e.g. the suction means) and the seabed. The seal may restrict a flow between an interior volume of the housing and an exterior volume of the housing (e.g. surrounding body of water).

In use, the at least one first opening may be closed, sealed and/or sealable to restrict the flow between the interior volume and exterior volume of the housing.

The lid may include at least one second opening or aperture. The second opening or aperture may receive or include a means for connecting one or more suction or pressure device(s), e.g. a (mechanical or centrifugal) pump, to the housing (suction means). In some examples, the suction or pressure device may be located at a surface structure, e.g. on a surface vessel, surface platform, surface rig or the like. In other examples, the suction device may be deployed at a remote subsea or surface location. One or more further conduit(s) or tubular(s), e.g. one or more umbilical(s) or the like, may connect the suction device to the housing. The suction or pressure device may be adapted to create an under pressure (negative pressure) or vacuum in the chamber of the housing, e.g. by evacuating the interior volume of the chamber of the housing. The suction or pressure device may create a pressure differential between the interior volume and exterior volume of the housing. Any fluids and/or particles, e.g. seabed material, contained within the chamber of the housing may be pumped by the suction devices into surrounding body of water (e.g. an exterior volume), creating the negative pressure or under pressure in the chamber. In some examples, an Remotely Operated Vehicle (ROV) may operate and/or connect the suction or pressure device to the housing, in use. In other examples, the suction device may be connected to the housing and/or suction means prior to deployment of the apparatus on the seabed.

In use, the under pressure within the chamber of the suction means may advance, drive or force the apparatus into the seabed thereby embedding or burying, e.g. at least partially embedding or burying, the apparatus within the seabed.

In use, the depth and/or rate of insertion of the apparatus into the seabed may be controllable. For example, the chamber may be evacuated for a certain time and/or using a certain pumping speed so as to embed and/or bury the apparatus at a pre-determined depth. The apparatus may comprise one or more guiding means, such a vertically spaced guiding lines or the like, for monitoring the depth and/or rate of insertion. For example, an ROV may be used to monitor the depth of insertion and/or position of the apparatus, in use.

In use, the apparatus may provide for the simultaneous installation of the at least one conduit and/or wellhead means by suction.

The wellhead means may provide a means for connecting one or more valve(s), such as those found on one or more blow out preventers (BOPs) and/or Christmas trees, marine drilling riser or the like.

Subsequent to installation, e.g. partial or complete embedment, of the apparatus on the seabed one or more valves, e.g. one or more blow out preventer (BOP) valves and/or stacks, may be installed on the apparatus. The one or more valves may be installed using a smaller surface vessel, such as a floating vessel. The installation of one or more valves on the apparatus may provide pressure control of the wellbore. For example, in wellbore formations containing shallow gas the installation of one or more valve may lead to increased safety during wellbore operations, such as (subsequent) drilling and/or jetting operations. Alternatively or additionally, one or more valves may be connected to the apparatus prior to deployment and/or installation of the apparatus on the seabed. The apparatus and/or wellhead means may be capable of supporting a weight of one or more BOP valves and/or stacks.

At least one tubular, such as a riser or marine drilling riser, may be installed to connect the one or more valves and/or the wellhead means to the surface structure, e.g. for subsequent wellbore operations, such as drilling and/or jetting. The apparatus may provide a connection, e.g. pressurised connection, from the wellhead means to the riser prior to any drilling and/or jetting operations. The riser may allow for recovery of drill cutting and/or drilling fluid, which may accumulate during (subsequent) drilling, jetting and/or piling operations. The apparatus may be capable of supporting the riser connected thereto and/or any dynamics or movement associated with the riser. Alternatively or additionally, the apparatus and/or wellhead means may be capable of withstanding any environmental loads, such as wave loading or the like.

The apparatus may provide means for installing subsea wellbore on the seabed without the need of drilling and/or jetting one or more top hole sections and/or installing one or more conduits with the wellbore.

The apparatus may include means for cementing the apparatus into the seabed. The means for cementing may have one or more tubular(s) which may be inserted into the at least one conduit for pumping the cement into the wellbore. Alternatively or additionally, cement may be pumped directly through the at least one conduit. The at least one conduit may have one or more perforations through which the cement may exit into the wellbore formation. Alternatively or additionally, the guiding portion of the at least one conduit may comprise one or more perforations through which the cement may exit into the wellbore formation.

According to a second aspect of the present invention there is provided a method of installing a wellbore on a seabed, the method comprising:

providing a wellbore installation apparatus in accordance with the first aspect of the invention;

lowering the apparatus into engagement with the seabed;

creating a pressure differential between an interior and exterior of the apparatus to force or drive the apparatus into the seabed.

The method allows for the installation of a barrier or well barrier, which may be capable of isolating and/or maintaining a (internal) wellbore pressure. The method allows for the simultaneous installation of a wellhead means and at least one conduit on the seabed.

The method may comprise controlling a depth or rate of insertion of the apparatus into the seabed. For example, the method may comprise adjusting an evacuating time and/or pumping speed so as to embed and/or bury the apparatus at a pre-determined depth.

The method may comprise establishing wellbore control by installing one or more valves on the wellbore installation apparatus. The one or more valves may comprise one or more BOP valves and/or Christmas tree valves. In some examples, the one or more valves may be connected to apparatus prior to deployment and/or installation. In other examples, the one or more valves may be installed subsequent to deploying and/or installing the apparatus on the seabed. Wellbore control may be established prior to any drilling or jetting operations.

The method may also include connecting piping or tubing, such as a riser or marine drilling riser, to the apparatus. The riser may be connected and/or connectable to the wellhead means and/or one or more valves.

The method may also include cementing the apparatus into the seabed. Cement may be pumped or directed through the at least one conduit. The cement may exist the conduit into the surrounding wellbore formation or environment via one or more perforations, which may be present in the at least one conduit and/or guiding portion of the at least one conduit.

It should be understood that the features defined above in accordance with any aspect of the present invention or below in relation to any specific embodiment of the invention may be utilised, either alone or in combination with any other defined feature, in any other aspect or embodiment of the invention.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
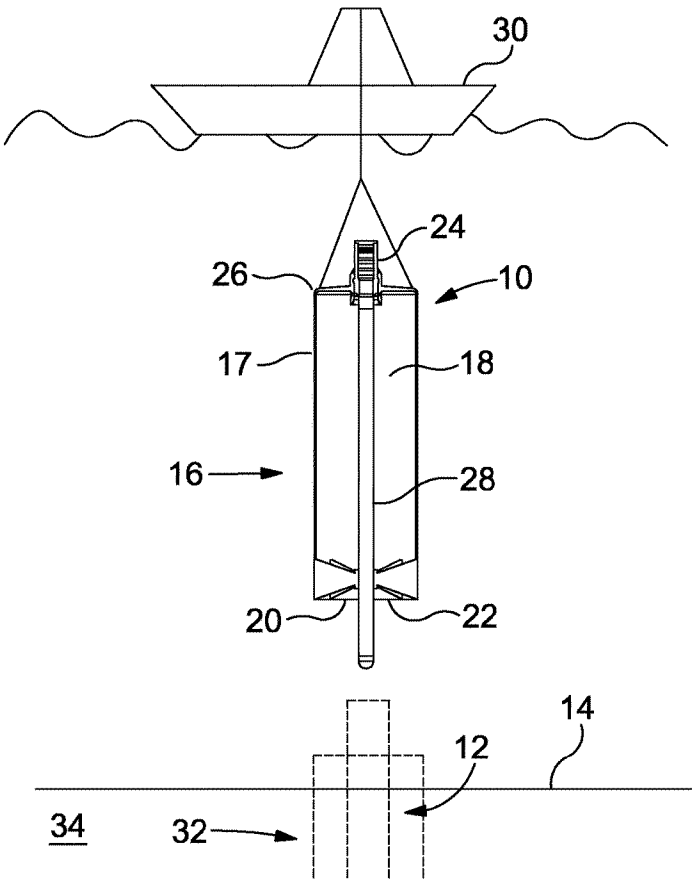
FIG. 1 is a diagrammatic view of an apparatus for installing a wellbore on a seabed in accordance with an embodiment of the present invention, with the apparatus shown suspended from a surface vessel.

Reference first is made to FIG. 1 in which there is shown an apparatus, generally indicated by reference numeral 10, for installing a wellbore 12 on a seabed 14 (shown in broken outline) in accordance with an embodiment of the present invention. The apparatus 10 comprises a suction member or anchor 16 comprising a housing 17 defining a chamber 18. The housing 17 has an open (bottom) end 20, defining a leading edge 22 for engagement with the seabed 14. The apparatus 10 also includes a wellhead 24 located at a (top) end 26 opposite the open end 20 and is engaged with a conduit 28, which extends substantially from the wellhead 24 through the chamber 18 beyond the leading edge 22.

As seen in FIG. 1, the apparatus 10 can be transported to a wellbore site by a vessel or barge 30. In this embodiment, the apparatus 10 is transported to a wellbore site by a supply vessel or dive support vessel 30 comprising an A-frame or the like, from which the apparatus 10 may be deployed.

When installed on the seabed 14 at a desired depth (as shown in broken outline), the apparatus 10 provides a well barrier 32, which is capable of isolating and/or maintaining a (internal) wellbore pressure. For example, the apparatus provides a barrier 32, which is capable of isolating pressurised well bore fluids from the surrounding formation and/or environment 34. The apparatus 10 advantageously enables the installation of the wellhead 24 and conduit 28 without the need of prior drilling and/or jetting operations at a wellbore site.

Figure 3:
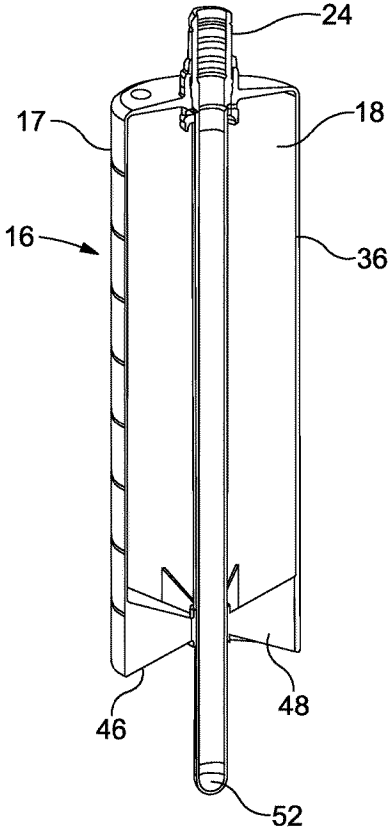
FIG. 3 is a longitudinal sectional view of the apparatus of FIG. 2.
Figure 2:
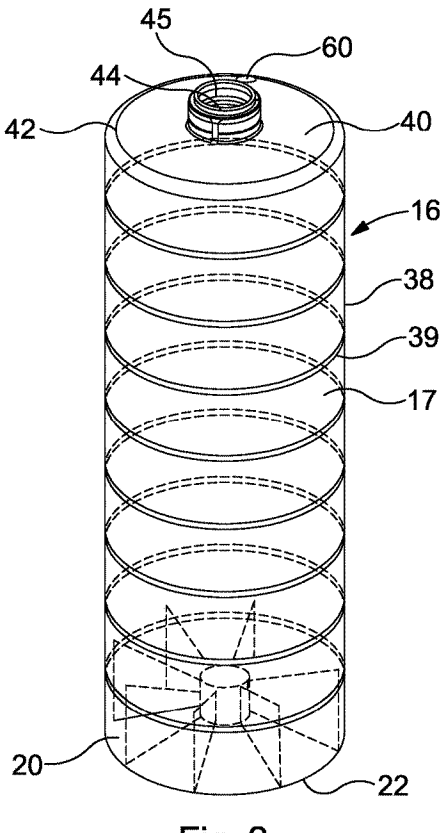
FIG. 2 is a perspective representation of a suction means of the apparatus of FIG. 1.
Figure 4:
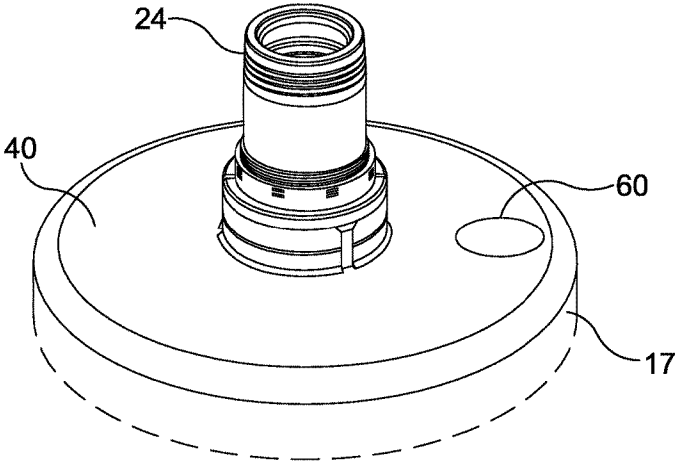
FIG. 4 is an enlarged representation of an end of the apparatus of FIG. 3 with a wellhead.

Referring to FIGS. 2, 3 and 4, the chamber 18 is formed or defined by the suction member 16. The suction member 16 comprises a cylindrical housing 17, which has a circular cover or lid 40 at the top end 26 and which is open at the open end 20. The housing 17 of the suction member 16 or a part thereof forms or defines a tubular member 38, which is arranged so as to at least partially surround the conduit 28. The lid 40 and tubular member 38 form the housing 17 and thereby, enclosing or defining the chamber 18 of the suction member 16. The lid 40 has an opening or aperture 44 for receiving the wellhead 24, which is coupled to the housing 17 of the suction member 16. The wellhead 24 is attached or fixed to the housing 17 so as to substantially restrict movement and/or deflection of the wellhead 24 with respect to the housing 17. In this embodiment, the wellhead 24 is fixed, such as rigidly fixed, to the suction means by a mechanical lock (not shown in the interest of clarity). The wellhead 24 can be mechanically pre-loaded into a profile 45 of the housing 17, which is capable of accepting and/or locking the wellhead 24 into the housing 17 and/or first opening 44 of the suction member 16, as shown in FIG. 4. The wellhead 24 is attached or fixed to the housing 17 so as to create a (low) pressure containing seal between the wellhead 24 and the housing 17. The wellhead 24 can be a high pressure wellhead 24, such as a slimline rigid lock down (SRLD) wellhead (e.g. from Aker Solutions).

Figure 5:
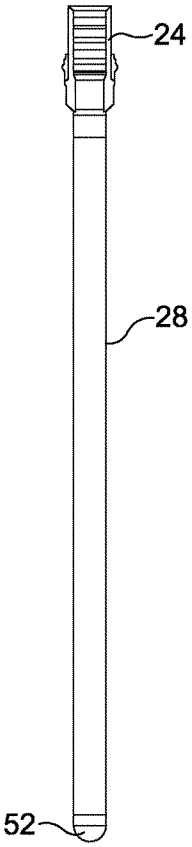
FIG. 5 is a representation of a conduit of the apparatus of FIG. 3 with the wellhead means connected thereto.

The wellhead 24 defines an interface for connecting, e.g. a casing hanger, the conduit 28 to the housing 17. In this embodiment, conduit 28 is integrally connected to the wellhead 24, as best seen in FIG. 5. The wellhead 24 fixes or attaches, e.g. rigidly fixes or attaches, the conduit 28 to the housing 17. The housing 17, wellhead 24 and/or the at least conduit 28 define or form, e.g. integrally define or form, the apparatus 10, as shown in FIGS. 2 and 3.

As can be seen in FIG. 3, the conduit 28 is coaxially arranged within the chamber 18 of the housing 17 and extends beyond the open end 20 of the housing 17. In this embodiment, the length of the conduit 28 is about 8 m. The length of the conduit 28 may depend on the wellbore site, e.g. properties of the formation etc.

The conduit 28 has a diameter of about 20 inch (50.8 cm).

The housing 17 has a diameter of about 150 inch (3.81 m). By providing the housing 17 with a diameter larger than that of the conduit 28, the structural integrity of the apparatus 10, such as a resistance to bending, is enhanced.

As can be seen in FIGS. 2 and 3, a conduit centraliser 46, which has a plurality of radial centralising members 48, is coupled between the interior of the housing 17 and the conduit 28 to maintain the conduit in a centralised position, as shown. The conduit centraliser 46 can also enhance the structural integrity of the apparatus 10. In this embodiment, the conduit centraliser 46 is provided proximal to the open end of the housing 17. The conduit centraliser 46 provides a first lateral load path. The wellhead 24 and/or the coupling of the conduit 28 to the housing 17 provide a second lateral load path vertically spaced from the first load path. The first and second lateral load paths can increase the resistance to bending of the conduit 28, housing 17 and/or apparatus 10.

Referring now to FIGS. 3 and 5, the conduit 28 has a guide shoe 52 with a rounded profile, located on a distal end of the conduit 28. The guiding shoe 52 facilitates engagement and penetration of the conduit 28 with the seabed 14 upon insertion of the apparatus 10 into the seabed 14.

Figure 6:
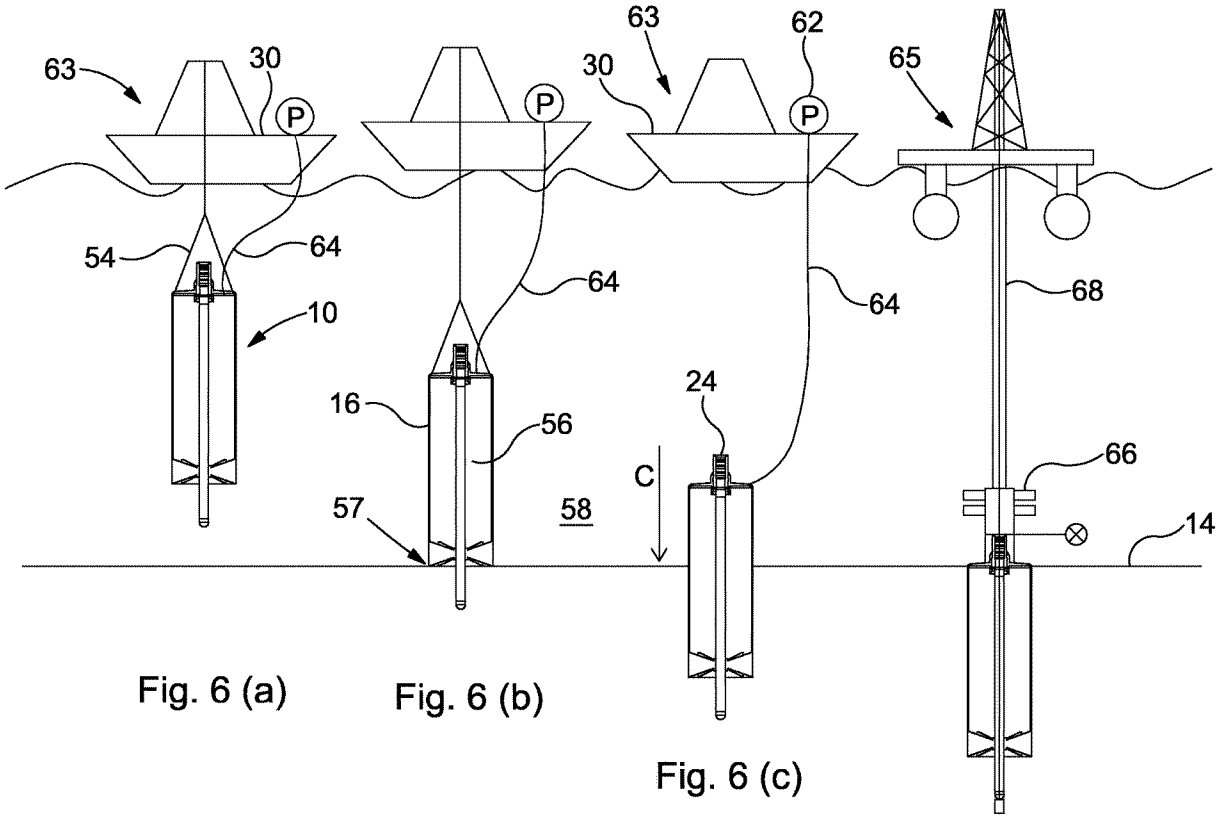
FIGS. 6(*a*), (*b*), (*c*) and (*d*) show views similar to FIG. 1 and illustrate how a method of installing the apparatus in the seabed is implemented.

Referring to FIGS. 6(*a*) to 6(*d*), which show how the apparatus 10 is deployed. Firstly, the apparatus 10 is suspended or suspendable from a vessel or surface vessel 30 (FIG. 6(*a*)). The apparatus 10 is then lowered from a vessel 30 to the seabed 14 by one or more tethers 54, lines, chains or the like so that it is initially located or positioned on the seabed 14 in an upright or vertical orientation, as shown in FIG. 6(*b*) and the leading edge 20 being on the seabed with the guide shoe 52 penetrating the seabed 14 due to a weight or self-weight of the apparatus 10. When this happens, a seal 57 is formed between the housing 17 and the seabed 14. The seal restricts flow between an interior volume 56 of the housing 17 and the surrounding body of water 58.

The lid 40 includes a further opening or aperture 60, as shown in FIGS. 2 and 4, which is configured to receive or connect to an umbilical 64 or the like for connecting a suction device 62 to the housing 17. The suction device 62 located on a surface structure 63, e.g. on a surface vessel 30, is connected to the housing 17 by the umbilical 64, as shown in FIGS. 6(*a*) to 6(*c*), and actuated to create an under pressure (negative pressure) or vacuum in the chamber 18 of the housing 17 by evacuating the interior volume 56 of the chamber 18. This creates a pressure differential between the interior volume 56 and exterior volume 58 of the housing 17. Fluids and seabed material contained within the chamber 18 of the housing 17 are pumped by the suction devices 62 into surrounding body of water 58, creating the negative or under pressure in the chamber of the housing 17.

In use, the pressure differential between the interior volume 56 of the chamber 18 and the surrounding body of water 58 drives or forces the apparatus 10 in a downwards direction C into the seabed 14, thereby embedding, e.g. partially embedding, the apparatus 10 within the seabed 14, as shown in FIG. 6(*c*). An ROV can be used to monitor the depth of insertion and/or position of the apparatus 10 in the seabed 14, in use. As shown in FIGS. 2 and 3, the apparatus 10 comprises vertically spaced depth guide lines 39, which can be used for monitoring the depth of insertion.

The wellhead 24 provides a means for connecting to one or more valve(s) 66, such as those found on one or more blow out preventers (BOPs) and/or Christmas trees, marine drilling riser or the like.

Subsequent to installation of the apparatus 10 on the seabed a BOP stack is installed on the apparatus 10, in use, as shown in FIG. 6(*d*), thus permitting pressure control of the wellbore 12, for example in wellbore formations 34 containing shallow gas, which can lead to enhanced safety.

Piping or tubing 68, such as a riser or marine drilling riser 68, can be installed to connect the BOP 66 and/or the wellhead 24 to a surface structure 63, such as a surface vessel 30, surface platform 65, surface rig or the like. The apparatus 10 provides a connection, e.g. pressurised connection, from the wellhead 24 to the riser 68 prior to any drilling and/or jetting operations. The riser 68 can be provided for subsequent drilling operations, as shown in FIG. 6(*d*). In this embodiment, the apparatus 10 is capable of supporting the riser 68 connected thereto and/or any dynamics or movement associated with the riser 68. The apparatus 10 and/or wellhead 24 is capable of withstanding any environmental loads, such as wave loading or the like.

The apparatus 10 and associated method of installing the apparatus 10 provide a means for installing a subsea wellbore 12 on the seabed 14 without the need of drilling and/or jetting one or more top hole sections and/or installing one or more conduits 28 within the wellbore 12. By removing the need for drilling of the top hole section, the deposition of drill cutting and/or drilling fluid into the environment is minimised or even eliminated. Alternatively or additionally, by removing the need for drilling of the top hole section, structural properties of the wellbore can be changed. For example, surface casings or the like can be replaced by apparatus 10 for providing structural stability of the wellbore 12.

The apparatus 10 and associated method of installation allows for the installation of the BOP to establish pressure control of the wellbore using smaller surface vessels. In wellbore formations containing shallow gas the installation of one or more valve leads to increased safety during wellbore operations, such as (subsequent) drilling and/or jetting operations.

By connecting the riser to the BOP 66 and/or the wellhead 24 prior to drilling, jetting and/or piling operations, drill cutting and/or drilling fluid, which may accumulate during drilling, jetting and/or piling operations may be recovered through the riser.

It should be understood that the embodiments described herein are merely exemplary and that various modifications may be made thereto without departing from the scope of the invention.

For example, the apparatus 10 may include a means for cementing the apparatus 10 into the seabed 14. The means for cementing can comprise one or more further tubular(s) (not shown) which are inserted into the conduit 28 for pumping the cement into the wellbore 12. Alternatively or additionally, the cement can be pumped directly through the conduit 28. The conduit 28 has one or more perforations (not shown) through which the cement exist into the wellbore formation 34. The guiding portion 54 of the at least one conduit 24 can comprise the one or more perforations through which the cement exit into the wellbore formation 34.

In the embodiment described hereinbefore, the conduit 28 can comprise at least one casing, conductor, tubular or the like.

For example, the conduit 28 and wellhead 24 may be forged from a single piece. The wellhead 24 can be arranged, e.g. integrally arranged, on or within the first opening 44 of the lid 40. In an alternative arrangement, the conduit 28 is releasably connected to the wellhead 24.

The wellhead 24 may be welded to the housing 17 or suction member 16. Alternatively, the wellhead 24 may be releasably attached or secured to the housing 17 or suction member 16 and/or the first opening 44 of the lid 40. Releasably coupling the conduit 28 to the housing 17 may allow for replacement and/or retrofitting of the conduit 28 to the housing 16.

The length of the conduit 28 may be in a range of 5 to 20 m. The diameter of the conduit 28 may be in the range of 10 to 30 inches (25.4 cm to 76.2 cm).

The diameter of the housing may be in the range of 50 inch to 200 inches (1.27 m to 5.08 m).

The conduit 28 may include a member (not shown) for suspending and/or connecting at least one further conduit (not shown). The suspending and/or connecting member may be a thread, connector, or the like.

In some examples, the apparatus 10 and/or housing 17 may comprise a plurality of conduit centralisers 46, which may provide a plurality of lateral load paths.

In some embodiments, the conduit 28 may coincide or be longitudinally aligned with the open end 20 of the housing 17. Alternatively, the conduit 28 may be retracted from the open end of the suction member 16, i.e. a length of the conduit may be smaller than a length of the suction member 16 or tubular member of the housing 17.

In an alternative embodiment, the apparatus 10 may be lowered to the seabed 14 using a wire and/or a spooled tensile member, such as coiled tubing (not shown). The suction device 62 may be deployed at a remote subsea or surface location.

The Remotely Operated Vehicle (ROV) (not shown) operates and/or connects the suction device 62 to the housing 17 (suction member 16), in use. In other embodiments, the suction device 62 may be connected to the housing 17 (suction member 16) prior to deployment of the apparatus 10 on the seabed 14. In alternative embodiments, the BOP 66 may be connected to the apparatus 10 prior to deployment and/or installation of the apparatus 10 on the seabed 14. The apparatus 10 and/or wellhead 24 may capable of supporting a weight of the BOP 66.

The apparatus and associated method of installation of the present invention provide a means for the fast and time efficient installation of wellbore and/or well barrier. The apparatus can be installed using a smaller vessel, i.e. the installation of the apparatus does not require use of a dedicated drilling vessel or rig. The apparatus and associated method of installing the apparatus provide a means for installing a subsea wellbore on the seabed without the need of drilling and/or jetting one or more top hole sections and/or installing one or more conduits within the wellbore. By removing the need for drilling of the top hole section, the deposition of drill cutting and/or drilling fluid into the environment is minimised or even eliminated. By removing the need for drilling of the top hole section, structural properties of the wellbore can be changed. For example, surface casings or the like is replaced by apparatus for providing structural stability of the wellbore.

The apparatus and associated method of installation of the present invention allows for the installation of the BOP to establish pressure control of the wellbore using smaller surface vessels. In wellbore formations containing shallow gas the installation of one or more valve leads to increased safety during wellbore operations, such as (subsequent) drilling and/or jetting operations By connecting the riser to the BOP and/or the wellhead prior to drilling, jetting and/or piling operations, drill cutting and/or drilling fluid, which may accumulate during drilling, jetting and/or piling operations are recovered through the riser.

The apparatus and/or housing of the present invention comprises one or more load paths, e.g. lateral load paths. By providing one or more lateral load paths, which may be vertically spaced or displaced from one another, structural integrity of the apparatus is enhanced, such as the resistance to bending of the at least one conduit, housing and/or apparatus, in use.

The invention claimed is:

1. An apparatus for installing a wellbore on a seabed wherein, prior to engagement with the seabed, the apparatus comprises a suction member comprising a housing defining a suction chamber having an interior volume, the housing having an open end, wherein the open end defines a leading edge for engagement with the seabed, and a wellhead located at an end of the housing opposite the open end for engagement with at least one well conduit, the at least one well conduit being fixed to the housing, wherein the at least one well conduit extends substantially from the wellhead through the interior volume of the suction chamber, wherein, when the wellbore is installed on the seabed, the apparatus provides a barrier or well barrier, which is capable of isolating and/or maintaining a wellbore pressure.

2. An apparatus for installing a wellbore on a seabed as claimed in claim 1, wherein the apparatus allows for the installation of the wellhead and/or the at least one well conduit without the need of prior drilling and/or jetting operations at a wellbore site.

3. An apparatus for installing a wellbore on a seabed as claimed in claim 1, wherein the housing of the suction member forms a tubular member or skirt and the housing is of a cylindrical and/or annular shape, and is arranged so as to surround the at least one well conduit.

4. An apparatus for installing a wellbore on a seabed as claimed in claim 1, wherein the housing of the suction member includes a lid, which is provided at the end opposite the open end.

5. An apparatus for installing a wellbore on a seabed as claimed in claim 4, wherein the lid is arranged so as to enclose or define the suction chamber of the housing.

6. An apparatus for installing a wellbore on a seabed as claimed in claim 4, wherein the open end is arranged opposite of the lid of the housing.

7. An apparatus for installing a wellbore on a seabed as claimed in claim 4, wherein the lid includes at least one first opening or aperture configured for receiving the wellhead.

8. An apparatus for installing a wellbore on a seabed as claimed in claim 1, wherein the at least one well conduit is releasably coupled to the housing.

9. An apparatus for installing a wellbore on a seabed as claimed in claim 1, wherein the at least one well conduit is integral with the housing.

10. An apparatus for installing a wellbore on a seabed as claimed in claim 1, wherein the housing, the wellhead, and/or the at least one well conduit defines and/or forms the apparatus.

11. An apparatus for installing a wellbore on a seabed as claimed in claim 1, wherein the at least one well conduit is concentrically and/or coaxially arranged within the suction chamber of the housing.

12. An apparatus for installing a wellbore on a seabed as claimed in claim 1, wherein the at least one well conduit protrudes or extends beyond the open end of the housing.

13. An apparatus for installing a wellbore on a seabed as claimed in claim 1, wherein the diameter of the housing is larger than a diameter of the at least one well conduit and the larger diameter of the housing enhances a structural integrity of the apparatus.

14. An apparatus for installing a wellbore on a seabed as claimed in claim 1, wherein the housing comprises one or more centralisers, arranged within the suction chamber of the housing.

15. An apparatus for installing a wellbore on a seabed as claimed in claim 1, wherein the at least one well conduit comprises or defines at least one guiding portion, located on a distal end of the at least one well conduit.

16. An apparatus for installing a wellbore on a seabed as claimed in claim 1, wherein in use, a seal is formed between the housing and the seabed.

17. An apparatus for installing a wellbore on a seabed as claimed in claim 4, wherein the lid includes at least one second opening or aperture, receiving or including a means for connecting one or more suction or pressure device(s) to the housing.

18. An apparatus for installing a wellbore on a seabed as claimed in claim 17, wherein in use, an under pressure within the suction chamber of the housing advances, drives or forces the apparatus into the seabed thereby embedding or burying the apparatus in the seabed.

19. An apparatus for installing a wellbore on a seabed as claimed in claim 1, wherein the at least one well conduit and the housing are directly attached to each other.

20. An apparatus for installing a wellbore on a seabed as claimed in claim 1, wherein the wellhead attaches the at least one well conduit to the housing.

21. An apparatus for installing a wellbore on a seabed as claimed in claim 1, wherein the wellhead is fixed to the housing so as to create a pressure containing seal between the wellhead and the housing.

22. An apparatus for installing a wellbore on a seabed as claimed in claim 1, wherein the wellhead is attached or fixed to the housing so as to create a pressure containing seal between the wellhead and the housing.

23. An apparatus for installing a wellbore on a seabed as claimed in claim 1, wherein the interior volume of the suction chamber is configured as a right cylinder.

24. An apparatus for installing a wellbore on a seabed as claimed in claim 1, wherein the apparatus further comprises one or more valves which are connected to the apparatus prior to deployment and/or installation of the apparatus on the seabed.

25. An apparatus for installing a wellbore on a seabed as claimed in claim 24, wherein the one or more valves comprise one or more BOP valves and/or Christmas tree valves.

26. An apparatus for installing a wellbore on a seabed as claimed in claim 1, wherein the apparatus includes means for cementing the apparatus into the seabed.

27. An apparatus for installing a wellbore on a seabed as claimed in claim 26, wherein the at least one conduit has one or more perforations through which cement exits into the wellbore formation.

28. A method of installing a wellbore on a seabed, the method comprising:

providing a wellbore installation apparatus, the apparatus comprising a suction member comprising a housing defining a suction chamber having an interior volume, the housing having an open end, wherein the open end defines a leading edge for engagement with the seabed, and a wellhead located at an end of the housing opposite the open end for engagement with at least one well conduit, the at least one well conduit being fixed to the housing, wherein the at least one well conduit extends substantially from the wellhead through the interior volume of the suction chamber, and wherein, when the wellbore is installed on the seabed, the apparatus provides a barrier or well barrier, which is capable of isolating and/or maintaining a wellbore pressure;

lowering the apparatus into engagement with the seabed;

creating a pressure differential between an interior and exterior of the apparatus to force or drive the apparatus into the seabed.

29. A method of installing a wellbore on a seabed according to claim 28, comprising cementing the apparatus into the seabed.

* * * * *